US008104458B2

(12) United States Patent
Hoffman

(10) Patent No.: US 8,104,458 B2
(45) Date of Patent: Jan. 31, 2012

(54) PROJECTILE LAUNCHER

(76) Inventor: Karl H. Hoffman, Tequesta, FL (US)

( * ) Notice: Subject to any disclaimer, the term of this patent is extended or adjusted under 35 U.S.C. 154(b) by 100 days.

(21) Appl. No.: 12/795,350

(22) Filed: Jun. 7, 2010

(65) Prior Publication Data

US 2011/0297134 A1 Dec. 8, 2011

(51) Int. Cl.
*F41B 6/00* (2006.01)

(52) U.S. Cl. ..... 124/3

(58) Field of Classification Search ..... 124/3
See application file for complete search history.

(56) References Cited

U.S. PATENT DOCUMENTS 3,504,480 A * 4/1970 Copcutt et al. ..... 96/21
4,307,529 A 12/1981 White et al.
H357 H * 11/1987 Howland et al. ..... 89/8
4,865,318 A 9/1989 Lehmann et al.
5,597,610 A 1/1997 Miura
5,800,288 A 9/1998 Mims
6,571,743 B1 6/2003 Curry
7,334,541 B2 2/2008 Reiter
2005/0155487 A1* 7/2005 Frasca ..... 89/8
2008/0006144 A1* 1/2008 Gaigler et al. ..... 89/8
* cited by examiner

*Primary Examiner* — Troy Chambers
(74) *Attorney, Agent, or Firm* — McHale & Slavin, P.A.

(57) ABSTRACT

A projectile launcher having a magnet based driver motor. The driver motor is constructed of a coil winding suspended within a magnetic field formed by the combination of a front plate, a magnet and a pole piece attached to a back plate. An electrical controller is electrically coupled to the driver motor and allows for remote operation of the launcher. The coil may include a diaphragm capable of producing sounds wherein electrical current applied to the coil winding causes the coil to vibrate according to an audio frequency to make a desired sound, or travel a predetermined distance so as to cause an ejection of a projectile placed over the coil.

17 Claims, 6 Drawing Sheets

PROJECTILE LAUNCHER

FIELD OF THE INVENTION

The present invention relates generally to the field of projectile launching devices and more particularly to an electromagnetically operated projectile launcher.

BACKGROUND OF THE INVENTION

It is well known to utilize a mechanical, pneumatically or electrically operated projectile launcher to propel objects. Numerous driver mechanisms are capable of projectile launching; the type of driver employed is typically based upon the primary purpose of a projectile launcher.

In an exemplary field of art, an object may be launched vertically for purposes of skill training and/or amusement. Skill training is recognized in various fields such as tennis wherein tennis balls are launched so as to allow a tennis player to understand and react to the ball movement; baseball wherein baseballs are launched so as to allow a baseball player to develop eye and swing coordination; K-9 training wherein treats are launched to reward a dog for performing a particular task; and so forth.

Conventional launching devices typically include a spring or pneumatic driver capable of storing energy for a quick release of an item. The problem with a spring operated launching device is that a spring must be compressed to create an energy reserve necessary for immediate release. Further, the actuator and mechanical components for a spring operated launcher are subject to wear and breakage and are relatively noisy.

Compressed air is an example of a driver with a simplistic operation. However, such a driver requires a cylinder capable of pressurization and a driver system capable of pressurizing the cylinder. The cylinder must be charged with sufficient compressed air as an energy reserve necessary for immediate release.

By way of example, a projectile launcher is used in K-9 training. In a technique known as positive reinforcement training, an animal trainer will reinforce the desired behavior by providing the K-9 with a reward when the animal accomplishes a particular desired task. The animal's reward for completing the proper behavior has been in the form of a motivational item that is hand-delivered or launched to the animal. Motivational objects include any item which, through instinctual or other reasons, the animal desires to receive. Examples of common motivational items and training objects include food, toys and other similar objects. The delivery of such motivational items has been limited by the animal trainer's ability to directly observe the specific behaviors of the animal and by the trainer's ability to mark and deliver the animal's reward in a timely fashion, which may be difficult when the animal is being trained in enclosed areas where it is difficult for the trainer to see or when there is a large distance between the animal and the trainer.

Attempts have been made to overcome some of these limitations on the trainer's training methods through the use of mechanical devices to, for example, deliver the reward to the animal such as by dropping the reward via gravity in place of the trainer. Such devices that are conventionally available have been restricted to a particular reward type, such as a specially designed ball specific to the particular device or a round ball in general.

What is known is that if an object is launched around an animal, instinctively the animal will chase the object and the catching of the object operates as a reward. Conventional prior art mechanical training devices take advantage of or initiate an animal's "prey drive." Such devices may propel the motivational object with enough speed to engage the animal's instinctual imperative to chase down and capture prey.

U.S. Pat. No. 7,334,541 discloses a device for shaping the behavior of an animal using a behavior marking and reward delivery system. The system includes a trigger assembly, a receiver, a spring assembly, and a bore assembly, and is capable of storing and propelling commonly used motivational items. The animal trainer manually compresses the spring assembly, which is then engaged by the trigger assembly. When the receiver receives a signal from a transmitter, it triggers the release of a motivational item from the device by activating the trigger assembly and/or triggers the occurrence of a marking event, such as a noise.

U.S. Pat. No. 4,307,529 discloses a remote control launcher for training retrieving dogs, incorporating a power handle of the type designed for explosive release of gas from a blank cartridge for launching. The launcher includes a housing supporting a power handle, a base for directing the power handle at a desired angle, a trigger mounted to the housing for engaging, controlling or releasing the firing pin actuating means of the power handle whereby a dummy mounted on the launching arm may be explosively launched. A radio receiver circuit controls a power supply to the launcher for sequentially firing a plurality of such launchers.

U.S. Pat. No. 6,571,743 discloses a training device to train dogs to recognize an object with a distinctive odor. An object with a distinctive odor can be placed in a position that the dog cannot touch or contact the object. The dog is allowed to sniff around the object and if the dog recognizes the object with the distinctive odor the dog demonstrates such recognition. The trainer, at a position remote from the dog and also from the object, can release the object so that it will be available to the dog and the dog can put the object in the dog's mouth or play with the object. The release of the object is a reward to the dog for the dog recognizing the distinctive odor.

What is lacking in the art is an electro-magnet projectile driver that eliminates the need for springs, compressed air, and provides a sounding device that can be programmed to further the training purpose.

SUMMARY OF THE INVENTION

Disclosed is a projectile launcher having a former, a coil and a magnet for use in the launching of an object. A driver motor is constructed of a winding of copper or aluminum wire about the former to form the coil. The coil is suspended within a magnetic field formed by the combination of a front plate, the magnet and a pole piece attached to a back plate. The coil may include a diaphragm capable of producing sounds. An electrical controller is provided to allow for remote operation of the launcher. When an electrical current is applied to the winding, the coil can vibrate according to the audio frequency to make a desired sound or travel a predetermined distance so as to cause an ejection of a projectile placed over the coil.

Accordingly, it is an objective of the invention to provide a launching apparatus based upon an electro-magnet capable of launching objects to various heights.

It is yet another objective of the invention to provide a launching device with minimal parts thereby simplifying the operation of the device and reducing the cost of manufacturing.

Yet another objective of the invention is to provide a launching assembly having an efficient projectile release mechanism.

A further objective of the invention is to provide a projectile launcher that includes a sound generator.

Still another objective of the invention is to disclose a launching device that automatically resets.

Another objective of the invention is to disclose the use of an electro-magnet driver assembly for use in launching K-9 treats for training purposes.

Another objective of the invention is to disclose the use of an electro-magnet driver assembly for use in launching K-9 training objects, such as a rolled up towel.

Another objective of the invention is to disclose the use of an electro-magnet driver assembly for use in launching tennis balls for training purposes.

Another objective of the invention is to disclose the use of an electro-magnet driver assembly for use in launching baseballs for training purposes.

Another objective of the invention is to disclose the use of an electro-magnet driver assembly for use in launching golf balls for training purposes.

Another objective of the invention is to disclose the use of an electro-magnet driver assembly for use in launching objects for entertainment.

Other objectives and advantages of this invention will become apparent from the following description taken in conjunction with the accompanying drawings wherein are set forth, by way of illustration and example, certain embodiments of the invention. The drawings constitute a part of this specification and include exemplary embodiments of the present invention and illustrate objects and features thereof.

DETAILED DESCRIPTION OF THE INVENTION

Figure 1:
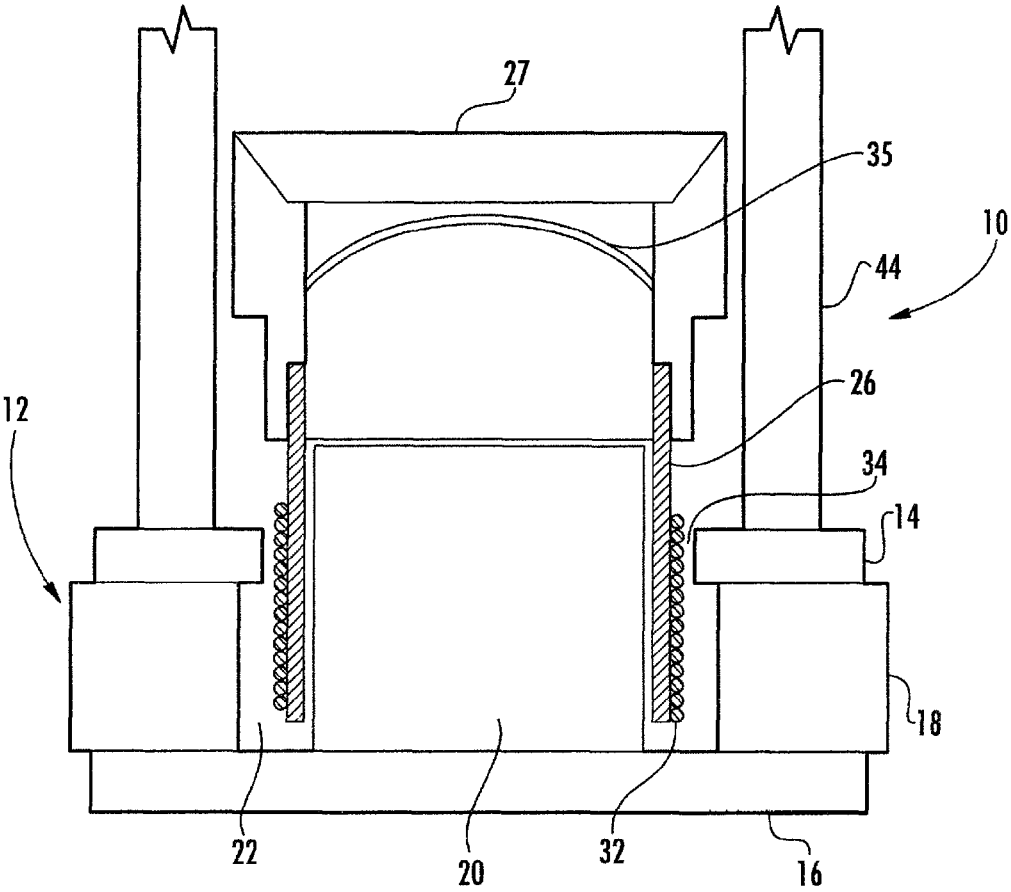
FIG. 1 is a cross sectional side view of a projectile launcher.
Figure 3:
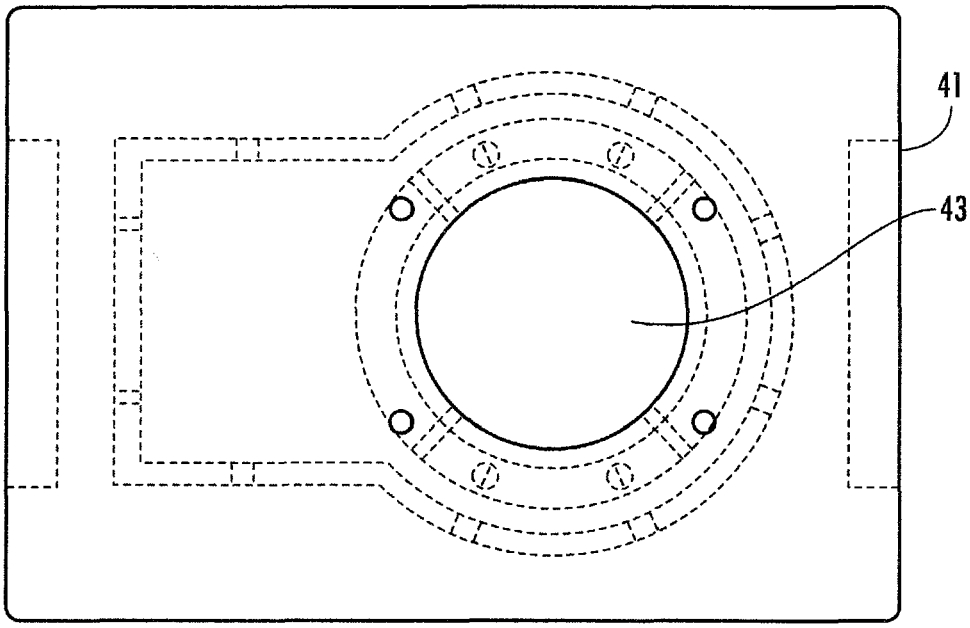
FIG. 3 is a top view of the projectile launcher tube top section.
Figure 2:
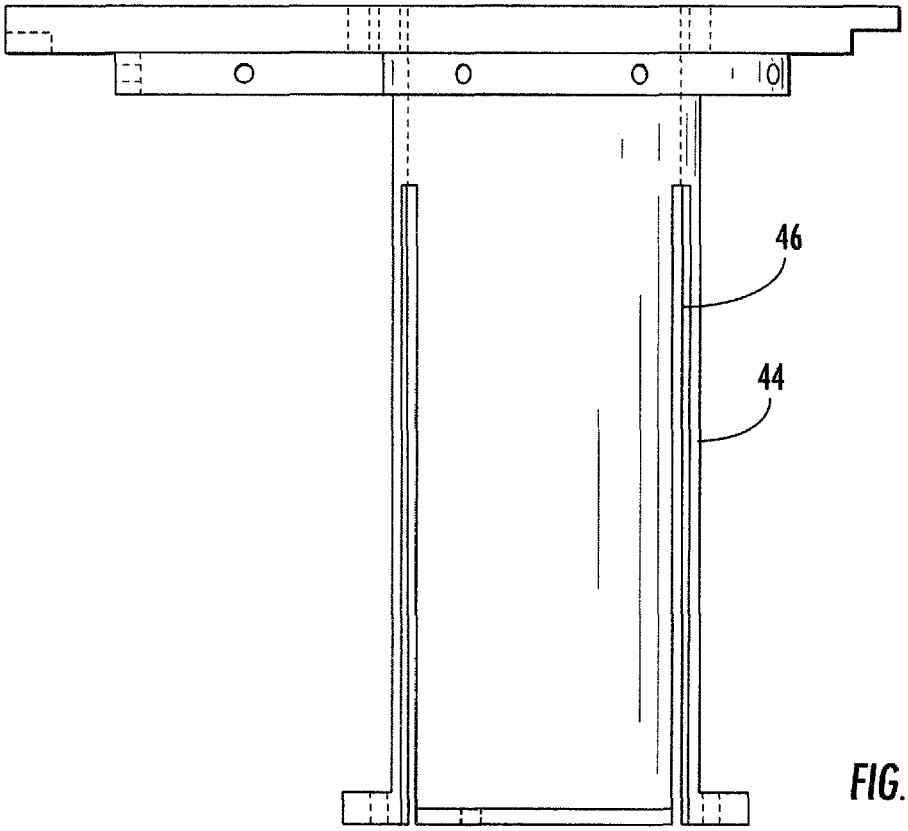
FIG. 2 is a cross sectional side view of the projectile launcher tube guide.

Although the invention will be primarily described in terms of a specific embodiment, it will be readily apparent to those skilled in this art that various modifications, rearrangements and substitutions can be made without departing from the spirit of the invention. The scope of the invention is defined by the claims appended hereto.

Now referring to FIGS. 1-3 and 4C, set forth is the projectile launcher 10 of the instant invention having a motor structure 12. The motor structure includes a front plate 14 and a back plate 16 which are spaced from one another by a permanent magnet 18, preferably a strontium ferrite magnet. A pole piece 20 is connected to and extends upwardly from the back plate 16 into a central bore 22 formed in both the magnet 18 and front plate 14. The pole piece 20 may be formed with a central bore or it may be solid. A coil 24 is formed from a hollow, cylindrical-shaped former 26, having an inner surface 28 and an outer surface 30 which receives a wire winding 32. The former 26 is concentrically disposed about the pole piece 20, and the coil is axially movable within a magnetic gap 34 formed between the front plate 14 and the pole piece 20. A cap 35 can be connected to the shuttle 27 which can operate as a platform base for the projectile to be launched. The wire winding 32 includes a first lead 40 and a second lead 42 for receipt of the electrical current used in moving of the shuttle 27. The cylindrical-shaped shuttle 27 is slidable within a guide 44 which is also cylindrical shaped, the former 26 fitting within the inner side wall 29 of the shuttle 27. The guide 44 includes alignment slots 46 extending along a length of the guide. Each alignment slot is receptive to alignment tabs 48 positioned around the shuttle 27. At a minimum, the use of two tabs allows for coupling to the wire winding 32 by use of the aforementioned leads 40 and 42. In the preferred embodiment, multiple tabs are placed around the shuttle 27 which are operatively associated with an adjoining slot 46 to provide precise alignment of the shuttle 27 as it slides along the inner surface of the guide 44. A top 41 is provided for attachment to the projectile launcher when the projectile launcher is placed into a box shaped embodiment such as the K9 training device. The top 41 includes an aperture 43 which aligns with the guide 44.

Figure 4:
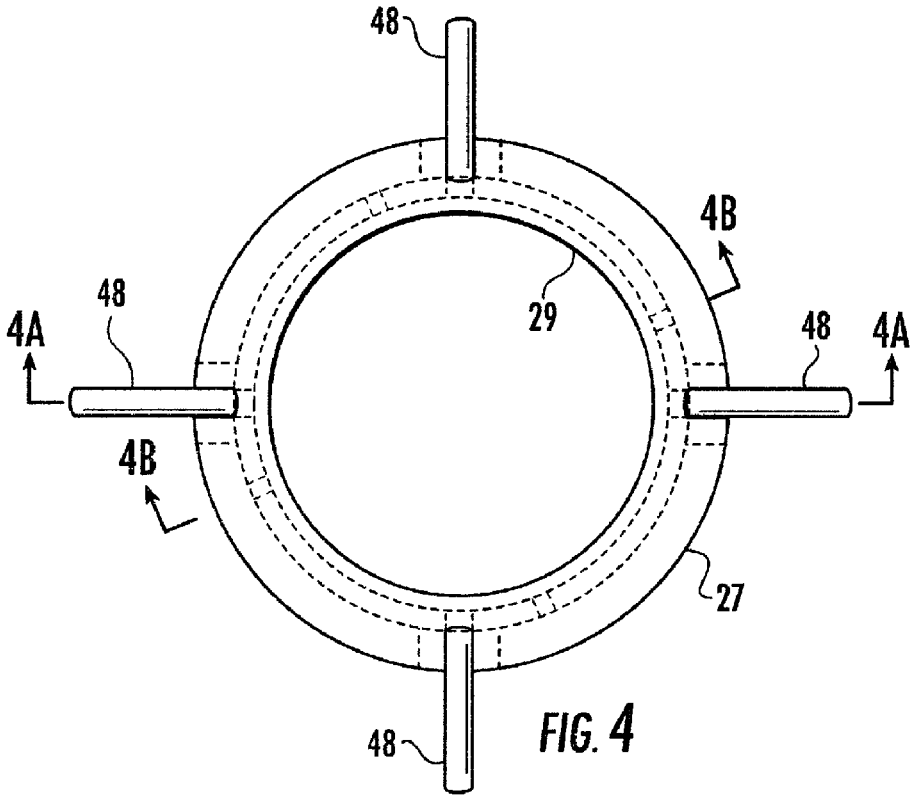
FIG. 4 is a top view of the projectile shuttle.
Figure 4A:
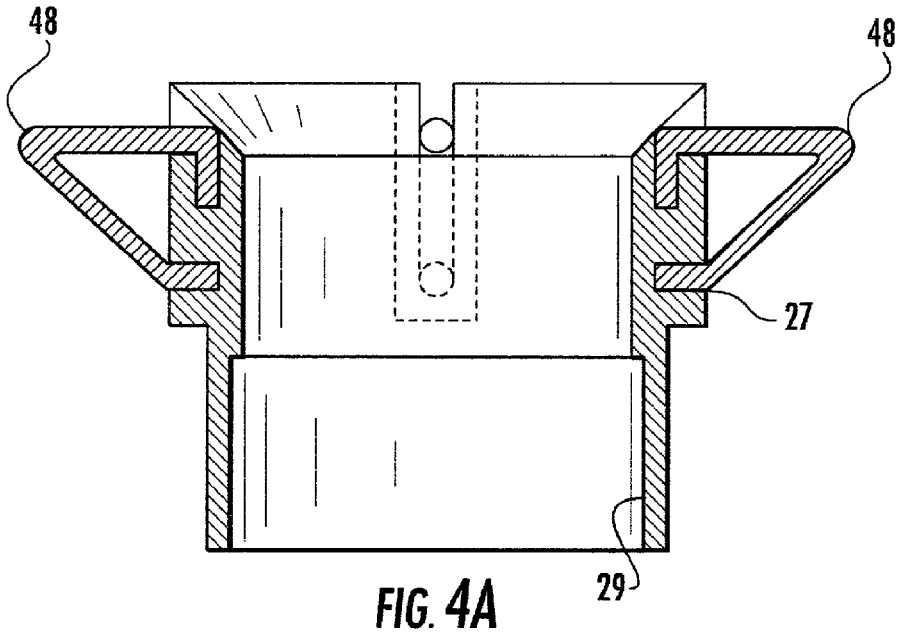
FIG. 4A is a cross sectional side view of FIG. 4 along section A-A.
Figure 4B:
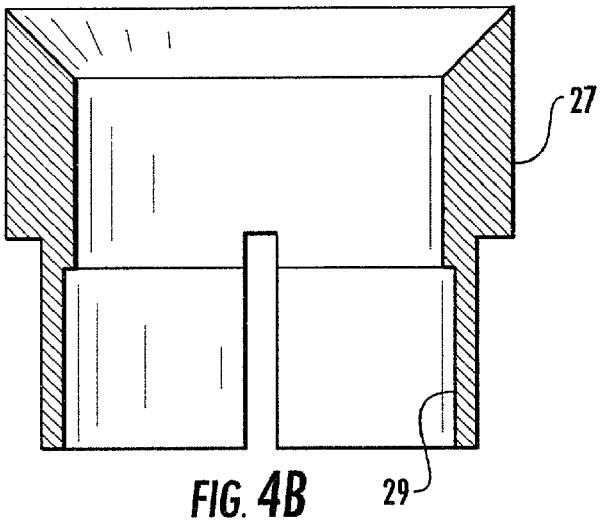
FIG. 4B is a cross sectional side view of FIG. 4 along section B-B.
Figure 4C:
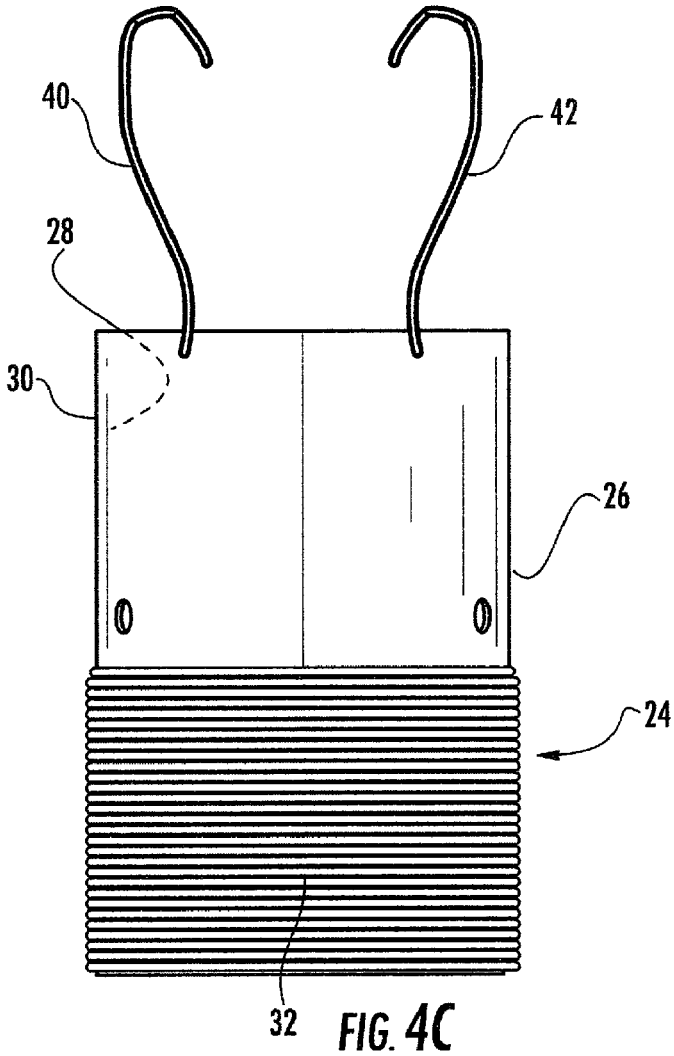
FIG. 4C is a side view of the shuttle launcher former and wire winding.

FIG. 4C illustrates the coil 24 which is formed from a hollow, cylindrical-shaped former 26, having an inner surface 28 and an outer surface 30 which receives a wire winding 32. The former 26 is placed inside shuttle 27 and concentrically disposed about the pole piece 20 axially movable within the magnetic gap 34 formed between the front plate 14 and the pole piece 20.

Figure 5:
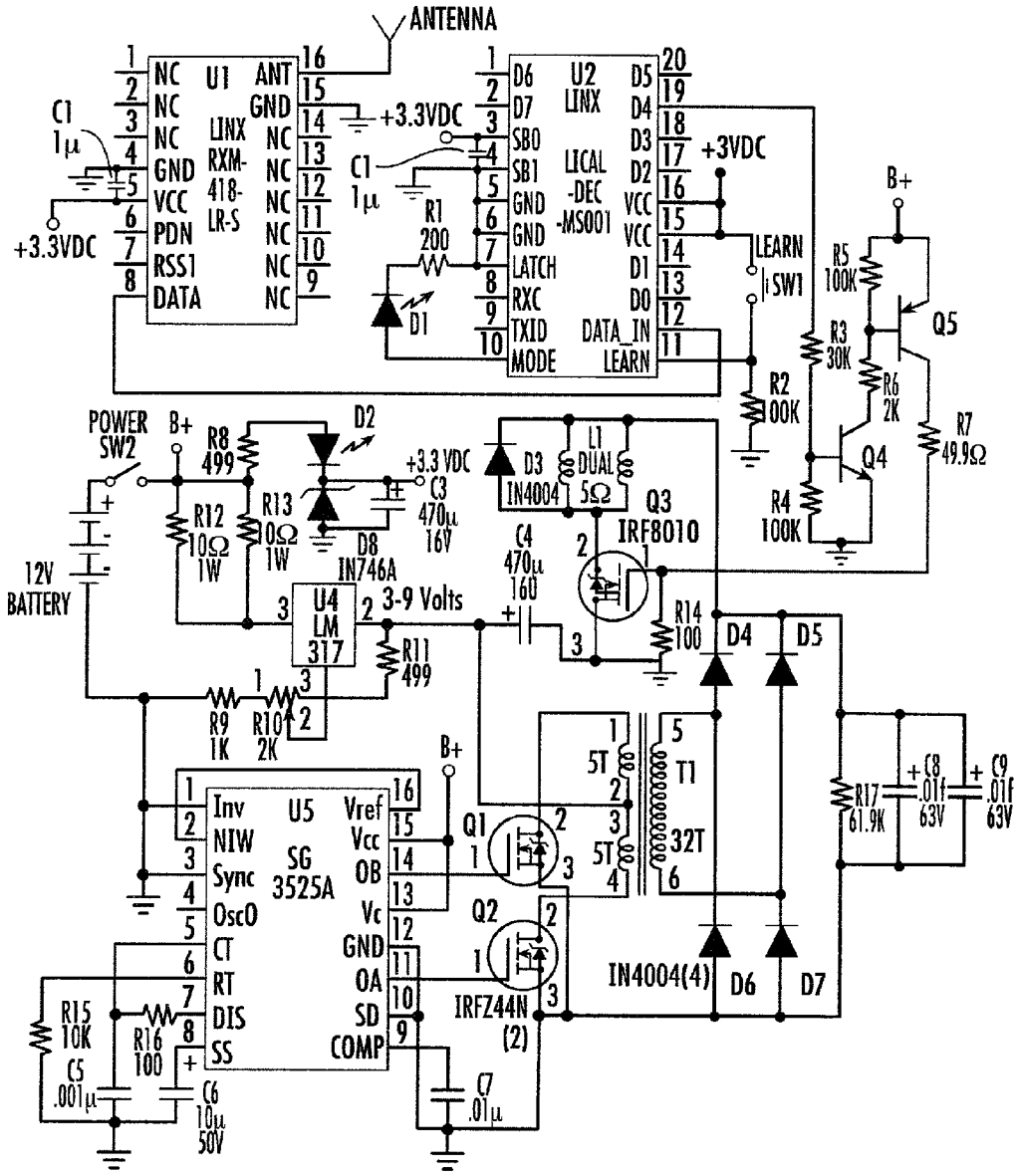
FIG. 5 is an electrical schematic.

Now referring to FIG. 5, a rechargeable 12 VDC battery supply, coupled to the circuit by manual switch SW2, provides 12 volt power to U5 inverter chip for pulse width modulator control to provide intermediate amounts of electrical power between an off and on position to mosfets Q1 and Q2 for amplification of the electrical signal to a step-up transformer T1. Diodes D4-D7 rectify the secondary winding of T1 to charge capacitors C8 and C9. Capacitors C8 and C9 are used to increase the available power for discharge through mosfet Q3 into coil L1, diode D3 provides free wheeling to the coil. The battery supply is also coupled into diode circuit D2 and D8 for regulating the voltage to 3.3 VDC for use in operating a remote control circuit. U1 operates as a long range receiver for the wireless transfer of command information in the range of 260-470 MHz band. When paired with a compatible transmitter, a reliable wireless link is formed, capable of transferring data at rates of up to 10,000 bps at distances in excess of 1,000 feet. The receiver operates in conjunction with decoder U2 which allows for the remote control and receipt of secure commands. The decoder can be used to define user groups and assign permissions to individual output lines. The outputs can be latched or momentary and secure address assignments can be instantly changed without DIP switches and a twenty-four bit address size provides for over 16,000,000 unique addresses making transmissions unique and secure and minimizing the possibility of multiple devices having conflicting addresses. The decoder also identifies and outputs the originating encoder ID for logging or identification.

Figure 6:
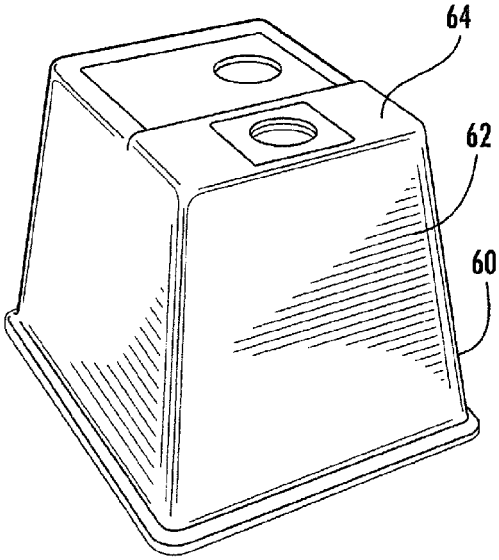
FIG. 6 is an illustration of the projectile launcher mounted within a K-9 launcher.
Figure 7:
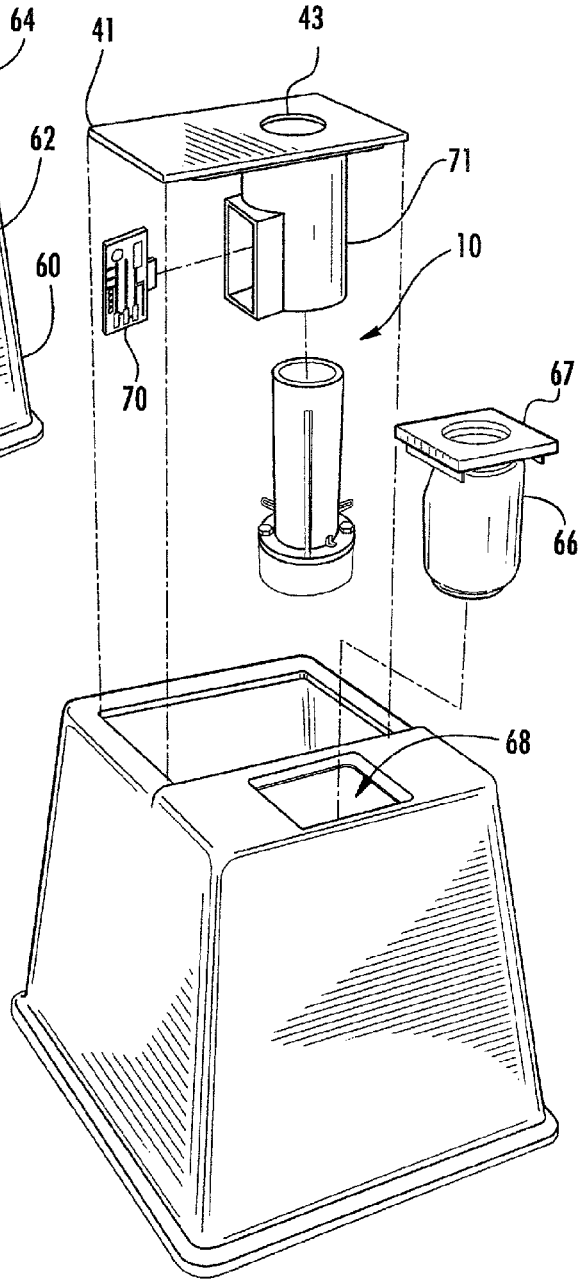
FIG. 7 is an exploded view of FIG. 6.

FIG. 6 depicts a K9 training embodiment having a housing 60 with side walls and a top surface. The projectile launcher can operate as an ejection device for K-9 training wherein a treat, such as a tennis ball, rolled up towel, edible food, or the like is ejected to reward the dog upon accomplishment of a task. In this embodiment the use of a remote control allows a trainer to provide positive reinforcement to a dog from a distance. The top surface 64 includes a sample container 66 secured to a support plate 67. The support plate is positioned within the aperture 68 wherein a K9 in training would be able to detect the scent from the substance. The projectile launcher 10, coupled to the top 41 has an aperture 43 available for expulsion of a projectile such as a towel roll, tennis ball, food treat, or any other item that the trainer deems usable for purposes of response training. The controller assembly 70, containing the aforementioned electrical circuit is attached to the tube cover 71 allowing for ease of access. A door may be placed over the aperture 43 to conceal treats from the K9. In operation, training materials are placed within the sample container 66, the top of the container is vented to allow the expulsion of detectable scents. The projectile unit is loaded with a rolled up towel which is projected upon the K9 detecting the scent from the material placed in the container 66. The shape of the housing 60 permits stacking for transporting or storage of multiple housings. This is a most important feature as it allows for the storage, transporting, shipping, and stacking of multiple units with minimal space.

It should be noted that the former 26, coil 24 and motor structure 12 are essentially a speaker, and as such, may include a diaphragm, not shown, wherein the assembly is capable of producing sounds. In such an embodiment the sounds created could replicate the sound of the trainer with a reinforcement statement such as "good dog" or any other statement of sound. The voice coil can be suspended within a magnetic field formed by the combination of the front plate, the magnet and the pole piece attached to the backplate. When an electrical current is applied to the winding, the speaker cone can then vibrate according to the audio frequency and polarity of the applied signal. The voice coil can be supported by a resin treated cloth material, commonly referred to as the speaker cone. The speaker cone is attached to the voice coil by an adhesive. The speaker cone is preferably formed of butyl rubber, neoprene, or the like material that are known for sound reproduction with good resistance to the elements. Movement of the voice coil creates audible sound.

Yet another embodiment would be to use the projectile launcher for use with a baseball wherein an individual is allowed to strike a ball without the use of a T-ball holder or tossing a ball with one hand. For instance, children learn the game of baseball by striking the ball as it is placed upon a holder. However, the holder does not provide good training for eye-to-ball coordination so the child is quickly retrained by having an individual toss a ball to the child. Having a fixed stand causes the child to rely upon another person for training. Similarly, older baseball players have a similar need for training and either need to toss the ball up with one hand or have the ball thrown at them. Use of a one hand toss allows an individual to practice but does not allow the individual to properly hold the baseball bat. Rather, the individual must quickly grasp the bat once he has tossed the ball in the air resulting in an unsecured handhold. In this embodiment the individual can be properly prepared to swing with both hands on the bat. The device can be operated from a distance and can include a sound generator stating "swing" which would be sounded at the proper moment.

For instance, U.S. Pat. No. 4,865,318 discloses a ball tossing device which includes a tossing mechanism and a foot pedal assembly which is manually depressible for actuating the tossing mechanism to toss a ball upwardly into the air so that it can be hit with a bat. The tossing mechanism includes a timer assembly which delays the ball tossing action of the device by a predetermined delay interval so that a batter can assume a fully ready position before the ball is tossed into the air.

U.S. Pat. Nos. 5,597,610 and 5,800,288 disclose a sport training apparatus for projecting a ball into the air for training an athlete in the proper technique of hitting or catching the ball. The apparatus includes ball projecting means and a spring connected thereto for movement between a cocked state and an actuated state. The spring is held in the cocked state by a partial vacuum automatically developed within an air chamber which is created when a piston enters a cylinder. The ball projecting means is pushed down which, in turn, causes the piston to enter the cylinder and create the air chamber. A check valve is connected to the air chamber to provide unrestricted air exit from the air chamber as the piston enters the cylinder. A pneumatic control release is connected to the air chamber for allowing ambient air to enter the air chamber for releasing some the vacuum to actuate the spring thereby causing the ball projecting means to propel the ball into the air where it can be hit or caught by the athlete.

Other uses of the projectile launcher can be for tennis practice. In a manner similar to baseball practice, a ball is tossed upward and those using two hands on the racket, such as with a backhand strike, are prepared to strike the ball. It should be noted that the projectile launcher device of the instant invention may include an automatic ball feeder so as to provide a continuous supply of practice balls. Additionally, this assembly may be sold as an unassembled kit containing the forgoing elements.

All patents and publications mentioned in this specification are indicative of the levels of those skilled in the art to which the invention pertains. All patents and publications are herein incorporated by reference to the same extent as if each publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A electro-magnetic projectile launching device comprising a cylindrical pipe having an inner surface with an upper open end and a lower end;

a driver magnet coupled to said lower end;

a former and shuttle constructed and arranged to fit between at least a portion of said driver magnet and movable along a length of said cylindrical pipe;

a control unit for directing an electrical charge to said former; and a rechargeable power source coupled to said control unit;

wherein an object placed within said upper open end of said cylindrical pipe is launched a distance in response to the electrical charge directed to said former.

2. The launching device according to claim 1 wherein said control unit includes a receiver for receipt of wireless actuation command from a remotely located RF transmitter.

3. The launching device according to claim 2 wherein said RF transmitter operates in the range of 260 MHz to 470 MHz.

4. The launching device according to claim 1 wherein said control unit includes at least one capacitor for storing of an electrical charge.

5. The launching device according to claim 3 wherein said capacitor is about 0.01 farads at 63 volts or higher.

6. The launching device according to claim 1 wherein said driver magnet is strontium ferrite.

7. The launching device according to claim 1 wherein said former is slidably disposed within said cylindrical pipe, said pipe having a plurality of alignment slots for coupling a winding formed on said former to the controller positioned external of said pipe.

8. The launching device according to claim 7 wherein said alignment slots constructed and arranged to limit the travel of said former along a predetermined length of said cylindrical pipe.

9. The launching device according to claim 1 including a diaphragm positioned between said former and said cylindrical pipe, wherein an audio frequency directed to said former produces sound.

10. The launching device according to claim 9 wherein said diaphragm forms a speaker cone, the movement of which creates an audible sound.

11. A K-9 electro-magnetic projectile launching device comprising:

a housing having a substantially flat top surface with side walls depending therefrom forming a cavity therebetween;

a receptacle for holding a scented object positioned within said housing;

a launching assembly mounted within said housing, said launching assembly comprising a cylindrical pipe having an inner surface with an upper open end extending through said flat top surface of said housing and a lower end placed within the cavity of said housing, a driver magnet coupled to said lower end; a former constructed and arranged to fit between at least a portion of said driver magnet and movable along a length of said cylindrical pipe; a control unit for directing an electrical charge to said former; and a receiver coupled to said control unit available for receipt of a wireless actuation command from a remotely located RF transmitter for operation thereof; and a rechargeable power source coupled to said control unit;

wherein upon a K-9 detecting a scented object placed in the receptacle, said control unit is engaged to launch an object placed within said cylindrical pipe whereby the launched object operates as a reward.

12. The launching device according to claim 11 wherein said control unit includes at least one capacitor for storing of an electrical charge.

13. The launching device according to claim 11 wherein said RF transmitter operates in the range of 260 MHz to 470 MHz.

14. The launching device according to claim 11 wherein said driver magnet is strontium ferrite.

15. The launching device according to claim 11 wherein said former is slidably disposed within said cylindrical pipe, said pipe having a plurality of alignment slots for coupling a winding formed on said former to the controller positioned external of said pipe, said alignment slots constructed and arranged to limit the travel of said former along a predetermined length of said cylindrical pipe.

16. The launching device according to claim 11 wherein said housing is stackable.

17. The launching assembly according to claim 11 that is removeable from said housing and can be placed in remote locations to hide launching assembly from a K-9's view.

* * * * *